US006897753B2

(12) United States Patent
Dixon

(10) Patent No.: US 6,897,753 B2
(45) Date of Patent: May 24, 2005

(54) HOUSING FOR A TRANSFORMER

(75) Inventor: Duane E. Dixon, Tucson, AZ (US)

(73) Assignee: Artesyn Technologies, Inc., Boca Raton, FL (US)

( * ) Notice: Subject to any disclaimer, the term of this patent is extended or adjusted under 35 U.S.C. 154(b) by 12 days.

(21) Appl. No.: 10/413,161

(22) Filed: Apr. 14, 2003

(65) Prior Publication Data

US 2004/0041674 A1 Mar. 4, 2004

Related U.S. Application Data

(60) Provisional application No. 60/408,078, filed on Sep. 3, 2002.

(51) Int. Cl.[7] ..... H01F 27/06

(52) U.S. Cl. ..... 336/65; 336/90; 336/92; 336/192; 174/52.1; 174/138 G

(58) Field of Search ..... 336/65, 90, 92, 336/98, 192, 210, 229; 174/52.1, 52.4, 52.5, 138 G

(56) References Cited

U.S. PATENT DOCUMENTS

| | | | | |
|---|---|---|---|---|
| 4,263,479 A | * | 4/1981 | Lange et al. | 178/46 |
| 4,356,344 A | | 10/1982 | Carey | |
| 4,548,365 A | | 10/1985 | Marzec et al. | |
| 4,602,122 A | * | 7/1986 | Lint | 174/52.1 |
| 4,621,311 A | | 11/1986 | O'Brien | |
| 4,754,370 A | | 6/1988 | DeTizio et al. | |
| 4,926,151 A | | 5/1990 | Morinaga | |
| 5,008,644 A | | 4/1991 | Cooper | |
| 5,212,345 A | | 5/1993 | Gutierrez | |
| 5,534,838 A | | 7/1996 | Lindberg | |
| 5,694,104 A | | 12/1997 | Lindberg | |
| 5,792,994 A | * | 8/1998 | Akahane | 174/138 G |
| 6,224,425 B1 | | 5/2001 | Shutter | |

OTHER PUBLICATIONS

Computer Products Stevens–Arnold Division, 15 Watt DC/DC Converters, brochure, Oct. 1985, pp. 1–4, data sheet No. 649, Computer Products Inc., South Boston, MA.

Stevens–Arnold Div., Hybrid Assy, drawing, Jan. 06, 1986, p. 1, dwg. No. LPS/S–B, USA.

Stevens–Arnold Div., Transformer Ass'Y, drawing, Feb. 28, 1986, pp. 1–2, dwg. No. IT–5475, So. Boston, MA.

Stevens–Arnold Div., Header Transformer Surface Mount, drawing, Mar. 12, 1986, p. 1, dwg. No. 2401–143, So. Boston, MA.

Computer Products Power Conversion Group, Power Supply Engineering Handbook, catalog, 1987, cover page and pp. 1, 142, Computer Products Inc., USA.

Magnetics, Ferrite Cores for Power and Filter Applications, catalog, 1988, pp. 1–4, Magnetics, USA.

* cited by examiner

*Primary Examiner*—Ramon M. Barrera
(74) *Attorney, Agent, or Firm*—Kirkpatrick & Lockhart Nickolson Graham LLP

(57) ABSTRACT

A housing for a transformer is disclosed. According to one embodiment, the housing includes a top portion, and first, second, third and fourth side portions connected to the top portion. The side portions define an opening. The third side portion includes a first alignment tab and the fourth side portion includes a second alignment tab. The housing also includes first, second, third and fourth termination legs. The first and second termination legs are proximate the third side portion, and the third and fourth termination legs proximate the fourth side portion. A transformer may be disposed in the opening defined by the side portions of the housing.

33 Claims, 8 Drawing Sheets

HOUSING FOR A TRANSFORMER

CROSS-REFERENCE TO RELATED APPLICATION

This application claims priority under 35 U.S.C. §119(e) from provisional U.S. Patent Application Ser. No. 60/408,078 filed Sep. 3, 2002, which is incorporated herein by reference.

BACKGROUND OF THE INVENTION

For power supplies that include one or more toroidal magnetic assemblies, the toroidal magnetic assemblies have traditionally been mounted either horizontally or vertically on either side of a printed circuit board. For applications requiring a relatively low profile, a toroidal magnetic assembly has traditionally been mounted in a horizontal orientation to limit the overall height of the printed circuit board assembly. However, mounting the toroidal magnetic assembly in a horizontal orientation consumes more surface area of the printed circuit board. The need for more surface area normally translates to a need for a larger printed circuit board that is more expensive to fabricate. For applications requiring a relatively small footprint, a toroidal magnetic assembly has traditionally been mounted in a vertical orientation to limit the impact the toroidal magnetic assembly has on the footprint of the printed circuit board assembly. However, mounting the toroidal magnetic assembly in a vertical orientation results in the printed circuit board assembly having a relatively tall profile, often rendering the printed circuit board assembly undesirable for applications requiring a relatively low profile. More efficient use of the surface areas of the printed circuit boards may contribute to decreased size requirements or higher device densities and improved performance of the power supplies.

SUMMARY OF THE INVENTION

In one general aspect, the present invention is directed to a housing for a transformer. According to one embodiment, the housing includes a top portion, and first, second, third and fourth side portions connected to the top portion. The side portions define an opening. The third side portion includes a first alignment tab and the fourth side portion includes a second alignment tab. The housing also includes first, second, third and fourth termination legs. The first and second termination legs are proximate the third side portion, and the third and fourth termination legs proximate the fourth side portion. A transformer may be disposed in the opening defined by the side portions of the housing.

In another general aspect, the present invention is directed to a transformer assembly. According to one embodiment, the transformer assembly includes a housing and a transformer. The housing includes a top portion, and first, second, third and fourth side portions connected to the top portion. The side portions define an opening in which the transformer is disposed. The third side portion includes a first alignment tab and the fourth side portion includes a second alignment tab. The housing also includes first, second, third and fourth termination legs. The first and second termination legs are proximate the third side portion, and the third and fourth termination legs proximate the fourth side portion.

In another general aspect, the present invention is directed to an electrical device. According to one embodiment, the electrical device includes a printed circuit board having first and second surfaces, and a transformer assembly mounted through the printed circuit board. The transformer assembly includes a housing and a transformer. The housing includes a top portion, and first, second, third and fourth side portions connected to the top portion. The side portions define an opening in which the transformer is disposed. The third side portion includes a first alignment tab and the fourth side portion includes a second alignment tab. The housing also includes first, second, third and fourth termination legs. The first and second termination legs are proximate the third side portion, and the third and fourth termination legs proximate the fourth side portion. The electrical device may be, for example, a power supply.

DESCRIPTION OF THE INVENTION

Figure 1:
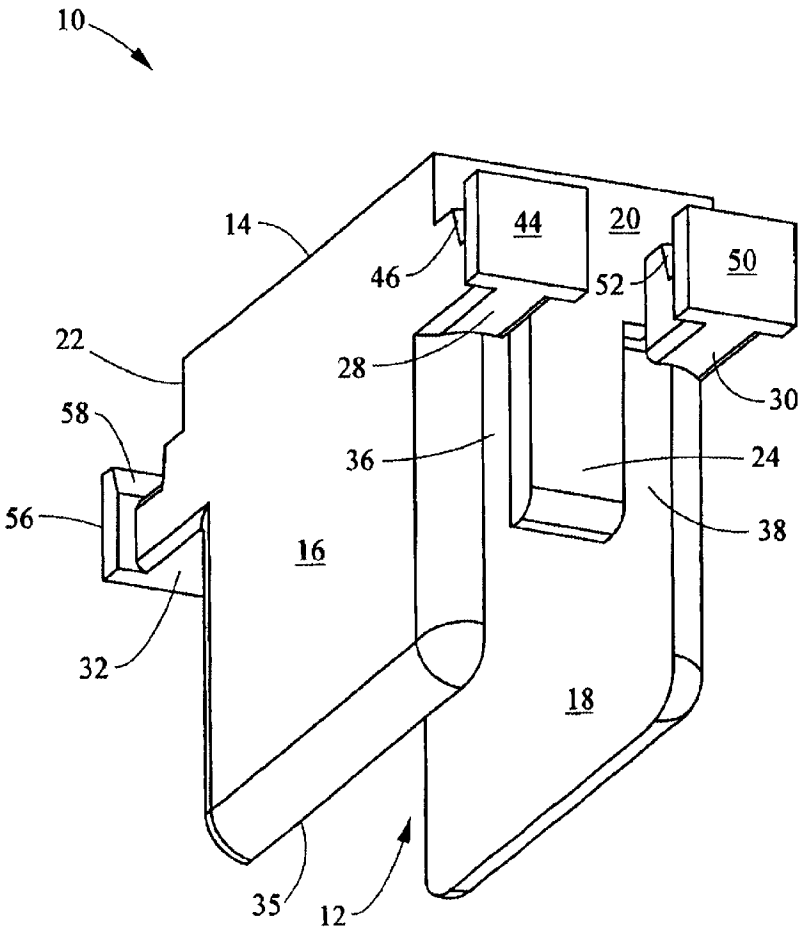
FIG. 1 illustrates one embodiment of a housing for a transformer.

FIGS. 1 and 2A–2C illustrate one embodiment of a housing 10 for a transformer. FIG. 1 is a perspective view of the housing 10 and FIGS. 2A–2C respectively illustrate a bottom view, a side view, and another side view of one embodiment of the housing 10 of FIG. 1. As illustrated, the housing 10 may define an opening 12 in which a transformer may be disposed as described further hereinafter. The housing 10 may be used for vertically mounting a transformer through a printed circuit board.

As shown in FIG. 1, the housing 10 may include a top portion 14, and first and second side portions 16, 18 adjacent and connected to the top portion 14. The first and second side portions 16, 18 may each include one or more pegs 19 that extend inward from the first and second side portions 16, 18 toward the opening 12. The pegs 19 may be used to help support a transformer disposed in the opening 12 of the housing 10. The housing 10 may also include third and fourth side portions 20, 22 adjacent and connected to the top portion 14. As illustrated, the side portions 16, 18, 20, 22 may define the opening 12, which may be, for example, a rectangularly shaped opening. The third side portion 20 may include a first alignment tab 24. The fourth side portion 22 may include a second alignment tab 26. The housing 10 may further include first and second termination legs 28, 30 proximate the third side portion 20, and third and fourth termination legs 32, 34 proximate the fourth side portion 22.

As shown in FIG. 1, the top portion 14 of the housing 10 may be substantially flat and orthogonal to the side portions 16, 18, 20, 22. The top portion 14 of the housing 10 maybe considered the top surface of the housing 10.

The first side portion 16 and second side portion 18 may face each other and may be connected to opposite edges of the top portion 14. In addition, the first and second side portions 16, 18 may be congruent. At least one of the first and second side portions 16, 18 may define a bottom surface 35 of the housing 10.

The third side portion 20 and the fourth side portion 22 may also face each other and be connected to opposite edges of the top portion 14. The third and fourth side portions 20, 22 may also be orthogonal to the first and second side portions 16, 18. Furthermore, the third and fourth side portions 20, 22 may be congruent. In addition, the first alignment tab 24 may oppose the second alignment tab 26 across the opening 12, and the first and second alignment tabs 24, 26 may be congruent. The first and second alignment tabs 24, 26 may be used as positioning guides to help position the placement of a transformer in the opening 12 of the housing 10. Together with the first side portion 16, the first alignment tab 24 may define a first access slot 36, which may be adjacent the first termination leg 28 and provide access to or from the opening 12 of the housing 10. In a similar manner, the first alignment tab 24 and the second side portion 18 of the housing 10 may together define a second access slot 38, which may be adjacent the second termination leg 30 and provide access to or from the opening 12.

Figure 2A:
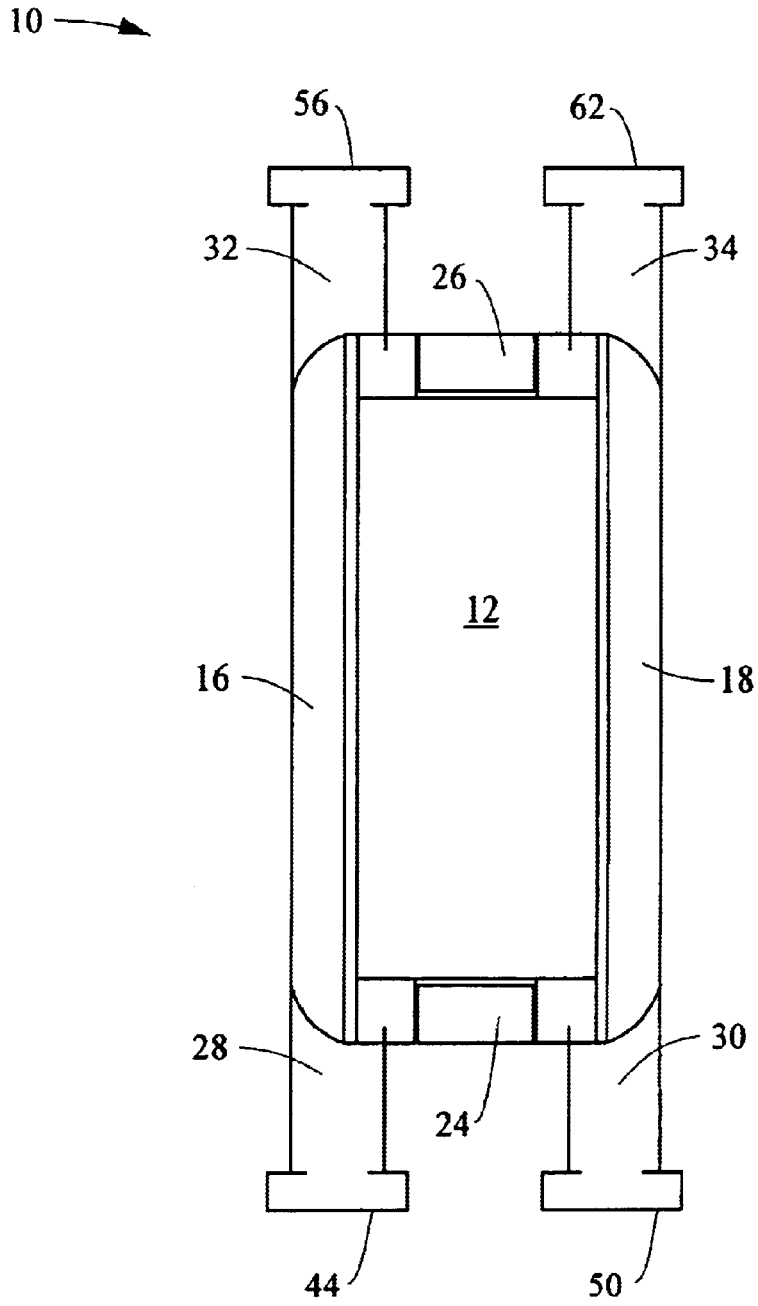
FIGS. 2A–2C respectively illustrate a bottom view, a side view, and another side view of one embodiment of the housing of FIG. 1.
Figure 2B:
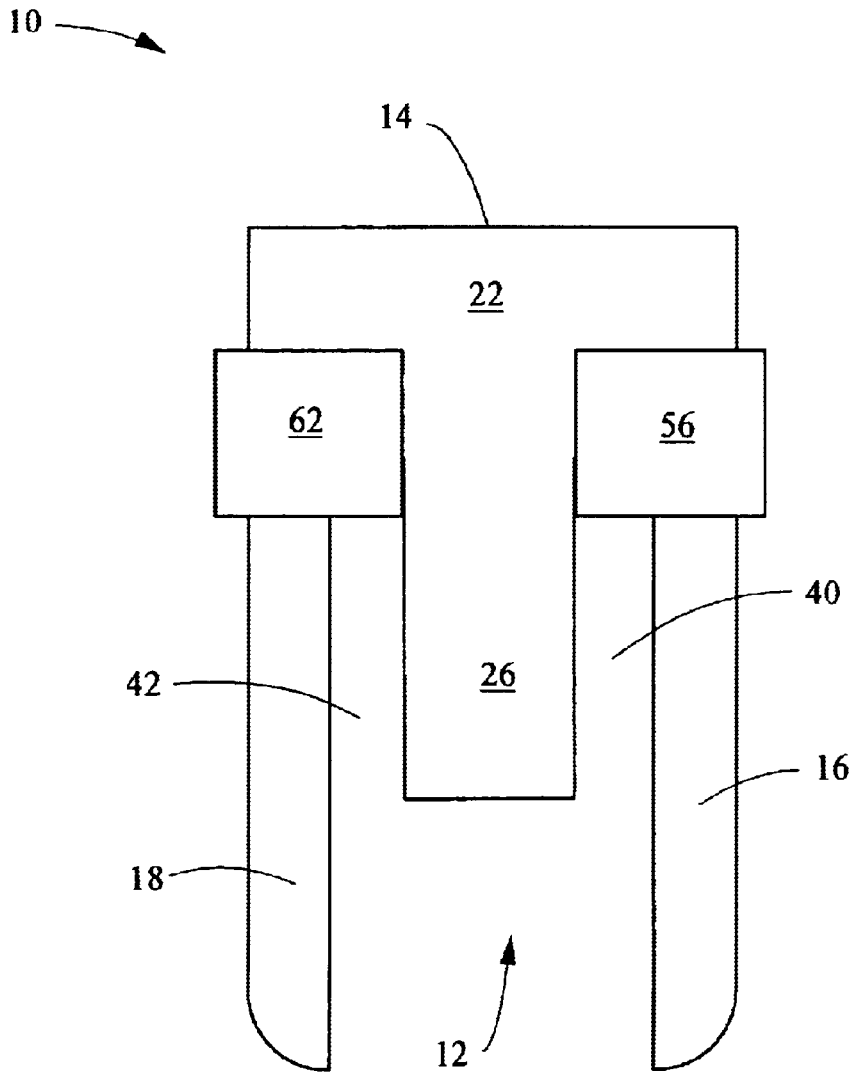
Figure 2C:
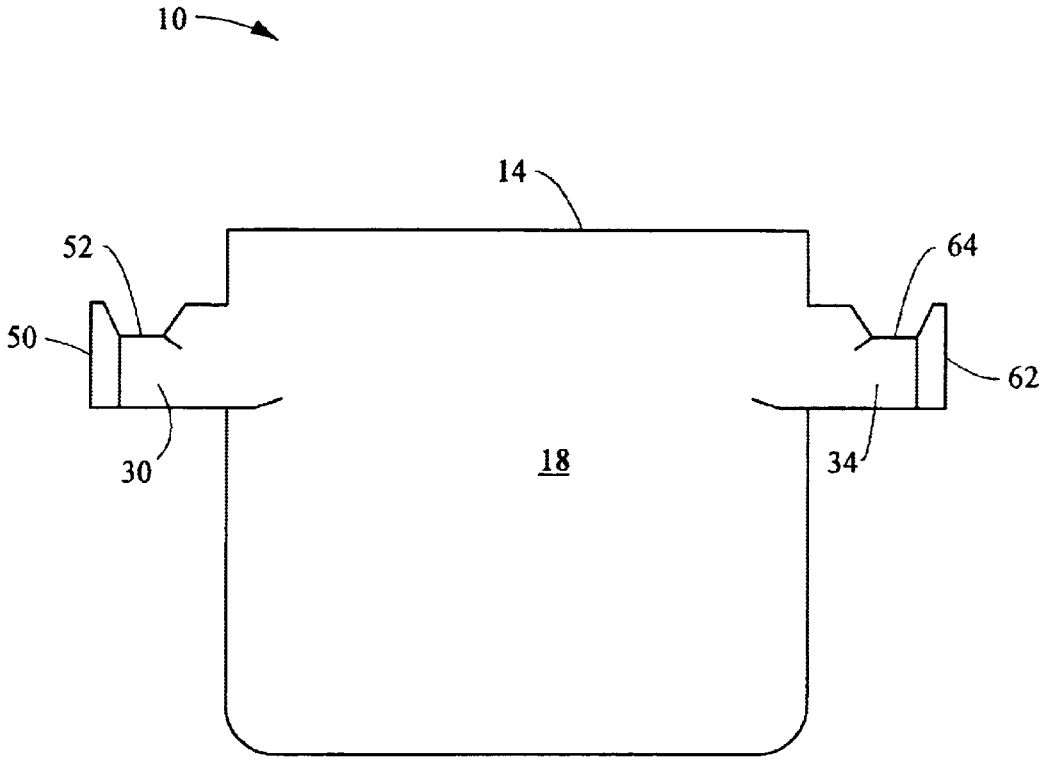

Similarly, first side portion 16 and the second alignment tab 26 may together define a third access slot 40, as shown in FIG. 2B, which may be adjacent the third termination leg 32 and provide access to or from the opening 12. In a similar manner, the second alignment tab 26 and the second side portion 18 of the housing 10 may together define a fourth access slot 42, as shown in FIG. 2B, which may be adjacent the fourth termination leg 34 and provide access to or from the opening 12. According to one embodiment, the first and second access slots 36, 38 may oppose the third and fourth access slots 40, 42, respectively, across the opening 12. According to one embodiment, the first, second, third and fourth access slots 36, 38, 40, 42 may be congruent.

The termination legs 28, 30, 32, 34 may include end portions 44, 50, 56, 62, respectively. In addition, the termination legs 28, 30, 32, 34 may respectively define first recesses 46, 52, 58, 64. According to one embodiment, each of the termination legs 28, 30, 32, 34 may also respectively define second recesses opposite the respective first recesses 46, 52, 58, 64. The termination legs 28, 30, 32, 34 may serve as termination points for leads of a transformer winding wire. According to one embodiment, as illustrated in FIGS. 1 and 2A–2C, the first and second termination legs 28, 30 may oppose the third and fourth termination legs 32, 34, respectively, across the opening 12. In addition, the termination legs 28, 30, 32, 34 may be congruent.

Although the housing 10 has been described hereinabove with respect to various portions and components, it is understood that the housing 10 may also be fabricated as a monolithic structure. According to such an embodiment, the housing 10 may be fabricated from, and therefore comprise, an electrically insulative material such as, for example, plastic.

Figure 3:
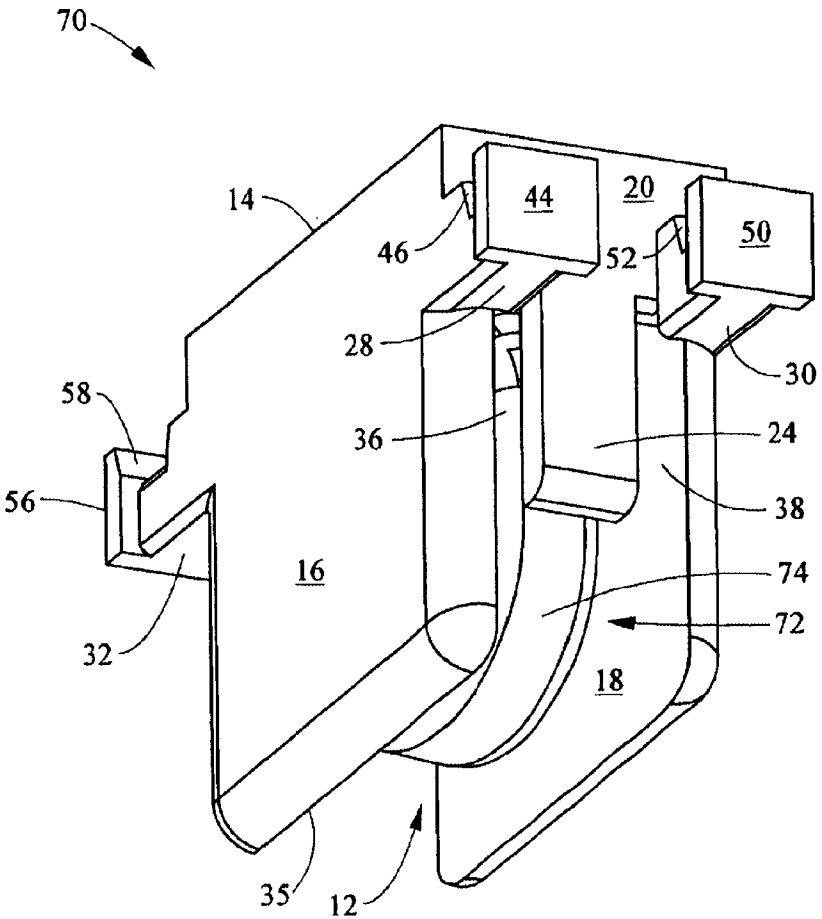
FIG. 3 illustrates one embodiment of a transformer assembly that includes the housing of FIG. 1.

FIG. 3 illustrates one embodiment of a transformer assembly 70 that includes the housing 10 of FIG. 1. According to one embodiment, the transformer assembly 70 may be surface mountable to, for example, a printed circuit board (PCB). In that regard, the top portion 14 of the housing 10 may be suitable for use with a pick-and-place machine. For example, a vacuum nozzle of the pick-and-place machine may be placed against the top portion 14 of the housing 10 to provide the suction needed to lift and set the transformer assembly 70 into position on the PCB.

In addition to the housing 10, the transformer assembly 70 may also include a transformer 72 such as, for example, a toroidal transformer, disposed in the opening 12 of the housing 10. According to one embodiment, the transformer 72 may be supported in the opening 12 of the housing 10 by the pegs 19 attached to the first and second sides 16, 18 of the housing 10. As described previously, the pegs 19 may extend inwardly from the side portions 16, 18 toward the opening 12. According to another embodiment, the transformer 72 may be secured to a portion of the housing 10 by an adhesive such as, for example, glue. The transformer 72 may include a ferrite core 74, and may include a number of windings wound around the ferrite core 74.

In one embodiment, for example, a primary winding of the transformer 72 may include lead portions respectively wrapped around the termination legs 28, 30, 32, 34 of the housing 10. That is, for example, a first lead portion may be wrapped around the termination leg 28 and a second lead portion may be wrapped around the termination leg 30. In a similar manner, another winding (e.g., secondary winding) of the transformer 72 may include lead portions respectively wrapped around the termination legs 32, 34. Such a configuration is shown in FIG. 4.

Figure 4:
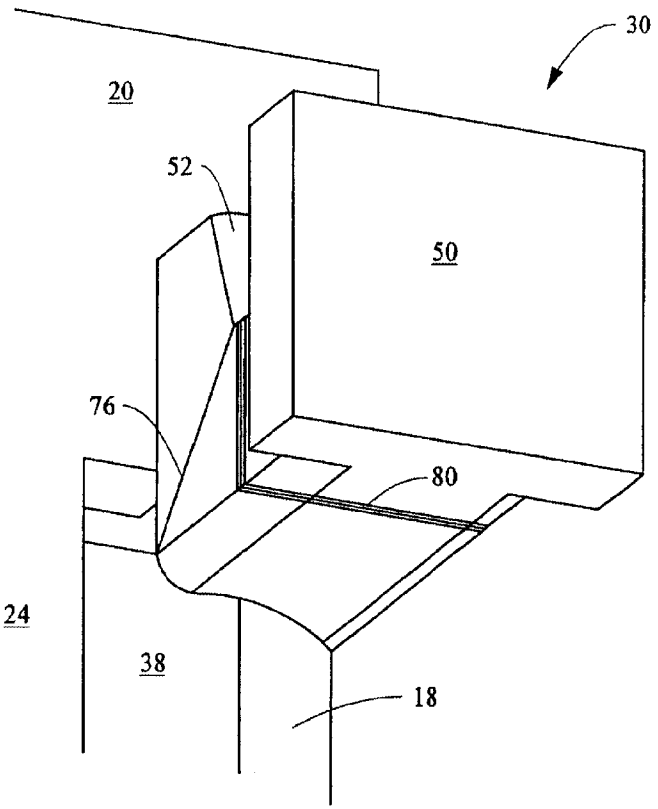
FIG. 4 illustrates one embodiment of the termination leg of the transformer assembly of FIG. 3.

FIG. 4 illustrates one embodiment of the termination leg 30 of the transformer assembly 70 of FIG. 3. As can be seen in FIG. 4, the winding 76 may be disposed in the second access slot 38, and may include a lead portion 80 wrapped around the termination leg 30 a number of times. The winding 76 may be disposed in the recess 52 (or recesses for an embodiment where the termination leg 30 defines multiple recesses). The recess 52 and the end portion 50 of the termination leg 30 may serve to prevent the lead portion 80 from straying from its wrapped position on the termination leg 30. Although FIG. 3A illustrates the second termination leg 30, the other termination legs 28, 32, 34 may be similarly configured.

Figure 5A:
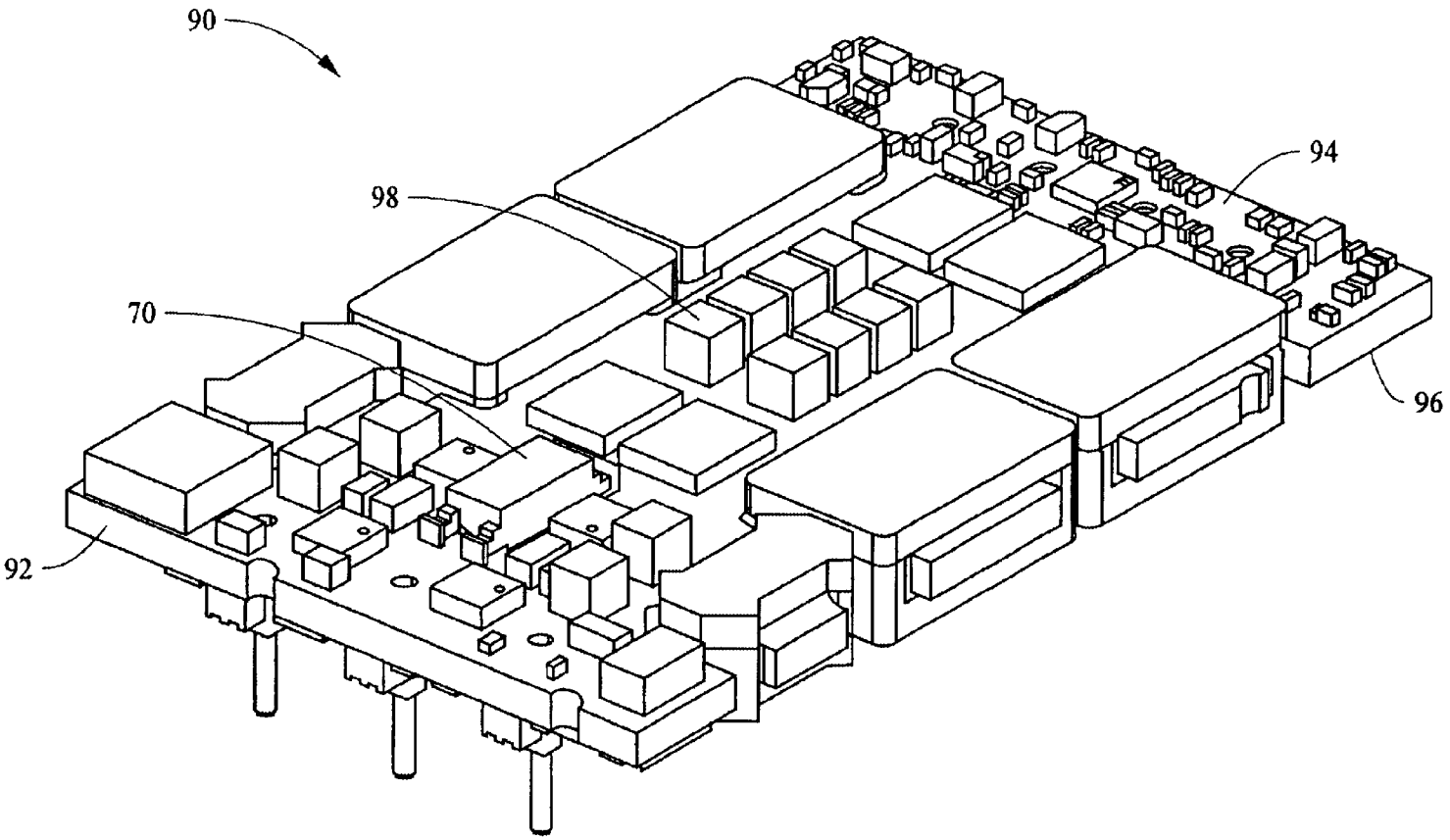
FIGS. 5A–5B illustrate top and bottom perspective views, respectively, of one embodiment of an electrical device that includes the transformer assembly of FIG. 3.
Figure 5B:
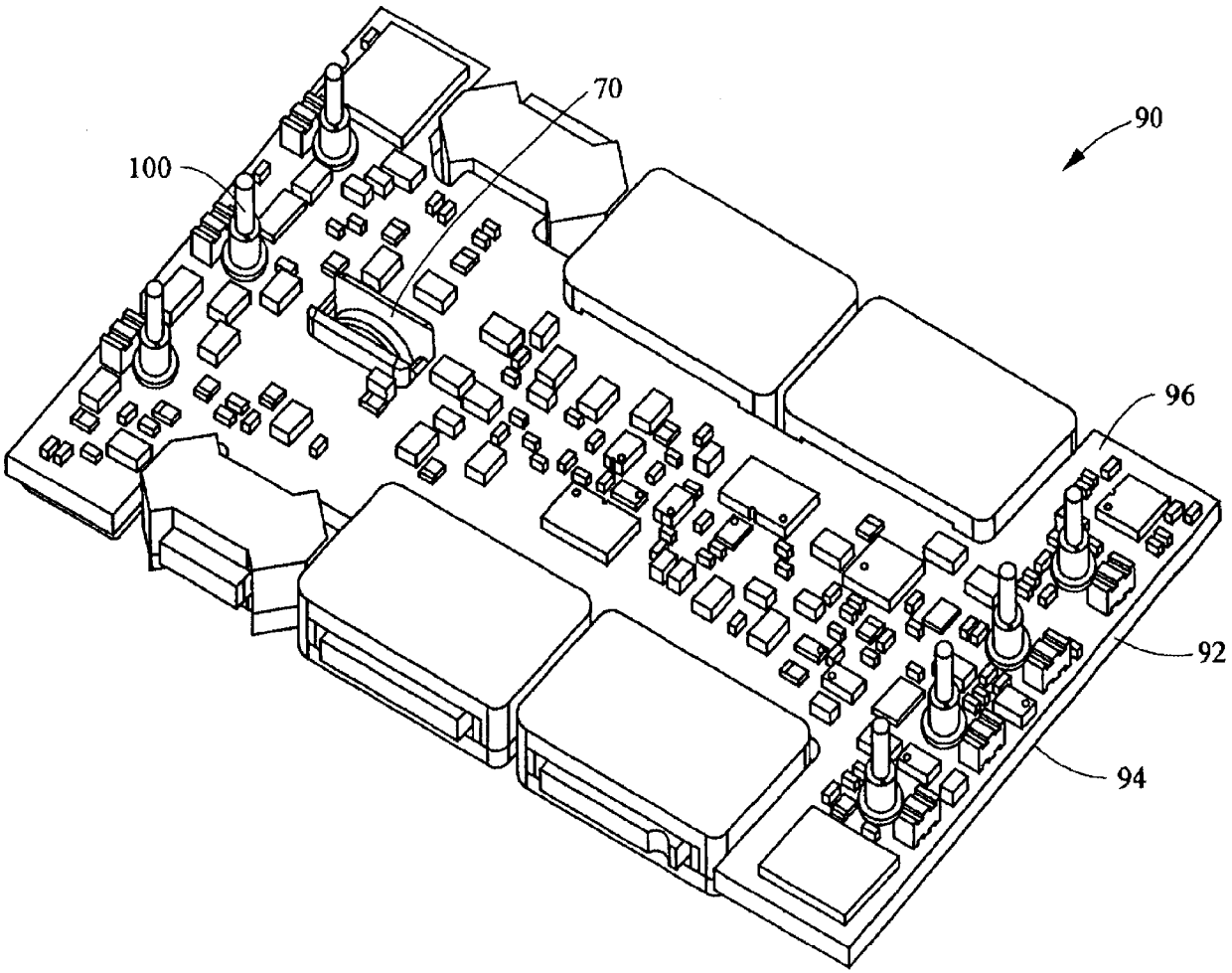

FIGS. 5A–5B illustrate top and bottom perspective views, respectively, of one embodiment of an electrical device 90 that includes the transformer assembly 70 of FIG. 3. According to one embodiment, the electrical device 90 may comprise a DC/DC power supply, or a portion thereof. The electrical device 90 may include a PCB 92 having first and second surfaces 94, 96. As shown in FIGS. 5A–5B, the PCB 92 may have the transformer assembly 70 of FIG. 3 connected thereto. According to one embodiment, the lead portions 80 of the winding 76 of the transformer 72 of the transformer assembly 70 (See FIG. 4) may be soldered to solder pads on the first surface 94 of the printed circuit board 92. According to such an embodiment, the transformer assembly 70 may be mounted through the PCB 92 such that the transformer 72 is positioned in a vertical orientation relative to the PCB 92. Mounting the transformer assembly 70 to the PCB 92 in this manner provides the advantages of consuming less surface area of the PCB 92 than mounting a similar sized planar magnetic assembly carrier in a horizontal orientation. The surface area saved by mounting the transformer assembly 70 in this manner may allow for the mounting of additional components to the PCB 92, or may allow for a reduction in the size of the PCB 92.

The first surface 94 of the PCB 92 may also have a first component 98 mounted thereto. The first component 98 may include at least one surface that is farther from the first surface 94 of the printed circuit board 92 than the top surface of the housing 10 of the transformer assembly 70 is. That is, the height of the first component 98 may be greater than the height of the transformer assembly 70 relative to the first surface 94 of the PCB 92. Thus, the height of the transformer assembly 70 above the first surface 94 of the PCB 92 need not be a controlling factor in the overall size of the electrical device 90. As shown in FIG. 5A, the first surface 94 of the PCB 92 may have a plurality of components mounted thereon, such as, for example, semiconductor switches, capacitors, inductors, resistors, diodes and integrated circuits.

As illustrated in FIG. 5B, the second surface 96 of the PCB 92 may have a second component 100 mounted thereon. The second component 100 may include at least one surface that is farther from the second surface 96 of the PCB 92 than the bottom surface of the housing 10 of the transformer assembly 70 is. Thus, similar to the height of the transformer assembly 70 above the first surface 94, the height of the transformer assembly 70 below the second surface 96 of the PCB 92 need not be a controlling factor in the overall size of the electrical device 90. As shown in FIG. 5B, the second surface 96 of the PCB 92 may also have a plurality of components mounted thereon.

While several embodiments of the housing 10 have been described, it should be apparent, however, that various modifications, alterations and adaptations to those embodiments may occur to persons skilled in the art with the attainment of some or all of the advantages of the present invention. This application is therefore intended to cover all such modifications, alterations and adaptations without departing from the scope and spirit of the present invention as defined by the appended claims.

What is claimed is:

1. A housing for a transformer, the housing comprising:

a top portion;

first, second, third and fourth side portions connected to the top portion, wherein the side portions define an opening, and wherein the third side portion includes a first alignment tab and the fourth side portion includes a second alignment tab;

first and second termination legs proximate the third side portion; and third and fourth termination legs proximate the fourth side portion.

2. The housing of claim 1, wherein the first and second termination legs are connected to the third side portion, and wherein the third and fourth termination legs are connected to the fourth side portion.

3. The housing of claim 2, wherein the housing comprises an electrically insulative material.

4. The housing of claim 3, wherein the electrically insulative material is plastic.

5. The housing of claim 2, wherein the top portion is substantially flat.

6. The housing of claim 2, wherein the opening is a rectangular opening.

7. The housing of claim 2, wherein the opening is for receiving a transformer.

8. The housing of claim 2, wherein the first alignment tab and the first side portion define a first access slot.

9. The housing of claim 8, wherein the first access slot is adjacent the first termination leg.

10. The housing of claim 8, wherein the first alignment tab and the second side portion define a second access slot.

11. The housing of claim 10, wherein the second access slot is adjacent the second termination leg.

12. The housing of claim 10, wherein the second alignment tab and the first side portion define a third access slot.

13. The housing of claim 12, wherein the third access slot is adjacent the third termination leg.

14. The housing of claim 12, wherein the second alignment tab and the second side portion define a fourth access slot.

15. The housing of claim 14, wherein the fourth access slot is adjacent the fourth termination leg.

16. The housing of claim 2, wherein the first termination leg defines at least one recess.

17. The housing of claim 16, wherein the second termination leg defines at least one recess.

18. The housing of claim 17, wherein the third termination leg defines at least one recess.

19. The housing of claim 18, wherein the fourth termination leg defines at least one recess.

20. A transformer assembly, comprising:

a housing, wherein the housing includes:

a top portion;

first, second, third and fourth side portions connected to the top portion, wherein the side portions define an opening, and wherein the third side portion includes a first alignment tab and the fourth side portion includes a second alignment tab;

first and second termination legs proximate the third side portion; and third and fourth termination legs proximate the fourth side portion; and a transformer disposed in the opening.

21. The transformer assembly of claim 20, wherein the first and second termination legs are connected to the third side portion, and wherein the third and fourth termination legs are connected to the fourth side portion.

22. The housing of claim 21, wherein the housing comprises an electrically insulative material.

23. The housing of claim 22, wherein the electrically insulative material is plastic.

24. The housing of claim 21, wherein the opening is a rectangular opening.

25. The transformer assembly of claim 21, wherein the transformer is a toroidal transformer.

26. The transformer assembly of claim 21, wherein the transformer assembly is surface mountable.

27. An electrical device, comprising:

a printed circuit board having first and second surfaces;

a transformer assembly mounted through the printed circuit board, wherein the transformer assembly includes:

a housing, wherein the housing includes:

a top portion;

first, second, third and fourth side portions connected to the top portion, wherein the side portions define an opening, and wherein the third side portion includes a first alignment tab and the fourth side portion includes a second alignment tab;

first and second termination legs proximate the third side portion; and third and fourth termination legs proximate the fourth side portion; and a transformer disposed in the opening.

28. The electrical device of claim 27, wherein the first and second termination legs are connected to the third side portion, and wherein the third and fourth termination legs are connected to the fourth side portion.

29. The electrical device of claim 28, wherein the electrical device is a power supply.

30. The electrical device of claim 28, wherein the transformer assembly is soldered to the first surface of the printed circuit board.

31. The electrical device of claim 28, wherein the first surface of the printed circuit board has a first component mounted thereto, and wherein the first component includes at least one surface that is farther from the first surface of the printed circuit board than the top surface of the housing is.

32. The electrical device of claim 31, wherein the second surface of the printed circuit board has a second component mounted thereto, and wherein the second component includes at least one surface that is farther from the second surface of the printed circuit board than the bottom surface of the housing is.

33. The electrical device of claim 28, wherein the transformer is a toroidal transformer.

* * * * *